US006010164A

United States Patent [19]

Yoda

[11] Patent Number: 6,010,164

[45] Date of Patent: Jan. 4, 2000

[54] IMPACT RESISTANT VEHICLE DOOR LATCH DEVICE

[75] Inventor: Yuji Yoda, Yamanashi-ken, Japan

[73] Assignee: Mitsui Kinzoku Kogyo Kabushiki Kaisha, Tokyo, Japan

[21] Appl. No.: 09/035,940

[22] Filed: Mar. 6, 1998

[30] Foreign Application Priority Data

Mar. 7, 1997 [JP] Japan ..... 9-070680

[51] Int. Cl.[7] ..... E05C 3/06

[52] U.S. Cl. ..... 292/216; 292/DIG. 41

[58] Field of Search ..... 292/213, 214, 292/216, 340, DIG. 41, DIG. 23, DIG. 55, DIG. 65

[56] References Cited

U.S. PATENT DOCUMENTS 3,591,220 7/1971 Sandor ..... 292/216

3,695,662 10/1972 Ploughman ..... 292/216

5,348,355 9/1994 Oyha ..... 292/11

*Primary Examiner*—Flemming Saether

*Assistant Examiner*—Gary Estremsky

*Attorney, Agent, or Firm*—Browdy and Neimark

[57] ABSTRACT

A vehicle door latch device has an improved door-holding force. The device comprises a latch accommodated in a housing which has a parallel plate parallel to a rotational plane of the latch and an approach path formed on the parallel plate for receiving the striker. The parallel plate has a first plate and a second plate partitioned with the approach path as a boundary. The latch is attached to the first plate. The second plate has a raised portion projecting toward the latch, and the latch has a hook which is engageably opposed to the raised portion when the door is in a door-closed position.

7 Claims, 6 Drawing Sheets

FIG. 7
(PRIOR ART)
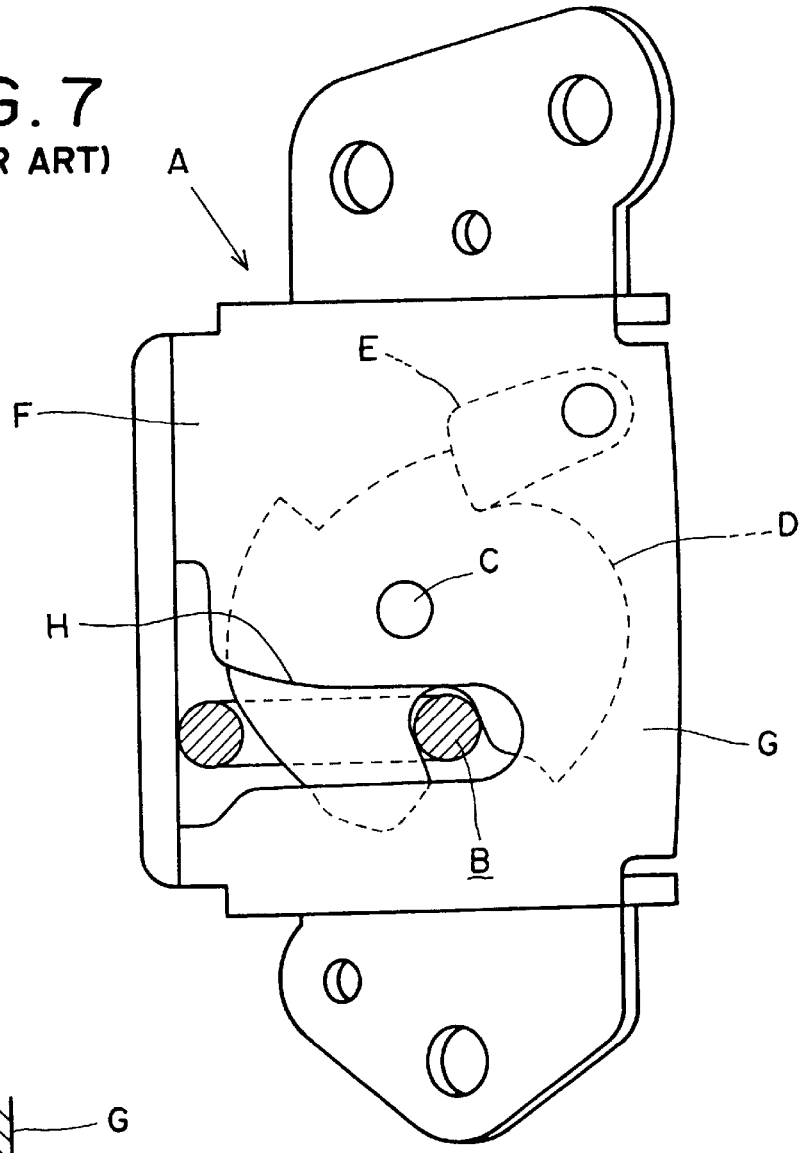
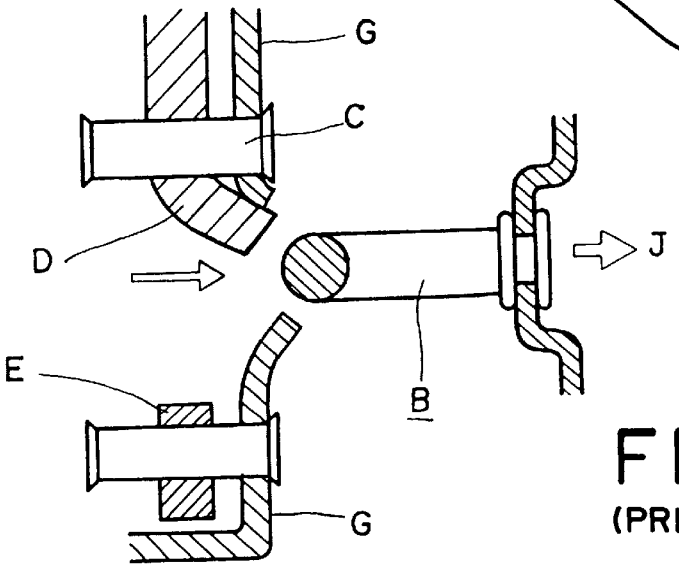
FIG. 8
(PRIOR ART)

IMPACT RESISTANT VEHICLE DOOR LATCH DEVICE

BACKGROUND OF THE INVENTION

1. Field of the Invention

The present invention relates to a vehicle door latch device which has an improved door-holding force for keeping a door in a closed position against a strong external force applied to the door by an automobile accident or the like.

2. Prior Art

As shown in FIGS. 7 and 8, a conventional door latch device has a housing A with a space fixed to one of a vehicle door and a vehicle body, a U-shaped striker B fixed to the other of the door and the vehicle body, a latch D rotatably mounted in the space by a latch shaft C and being engageable with the striker B, and a ratchet E rotatably mounted in the space and being engageable with the latch D for holding the engagement between the latch D and the striker B. The housing A has a base F which contains a parallel plate G substantially parallel to a rotational plane of the latch D, and an approach path H formed on the parallel plate G for receiving the striker B when the door is closed.

The strength or door-holding force of the latch device essentially depends on thickness of each of the latch D and the base F, and a diameter of the latch shaft C.

FIG. 8 shows test results obtained by applying a large load to the conventional latch device. As can be clearly seen from FIG. 8, when the striker B is strongly pulled by the large load in the direction of an arrow J parallel to an axis of the latch shaft C, the latch D and the plate G of the base F are bent, and the striker B is then disengaged from the latch D, thereby the door is open.

SUMMARY OF THE INVENTION

Therefore, an object of the present invention is to provide a door latch device having improved door-holding force for keeping a door in a door-closed position against a strong external force applied to the door.

Another object of the present invention is to provide a reinforcing means which can be simply and easily utilized in the conventional latch devices.

A still another object of the present invention is to provide a door latch device having improved door-holding force without increasing substantial weight and cost thereof.

BRIEF DESCRIPTION OF THE DRAWINGS

FIG. 7 is a front view of a conventional door latch device; and

FIG. 8 is an explanatory view showing a state in which a load is applied to a conventional striker in a direction parallel to an axis of a latch shaft.

DETAILED DESCRIPTION OF THE PREFERRED EMBODIMENTS

Figure 1:
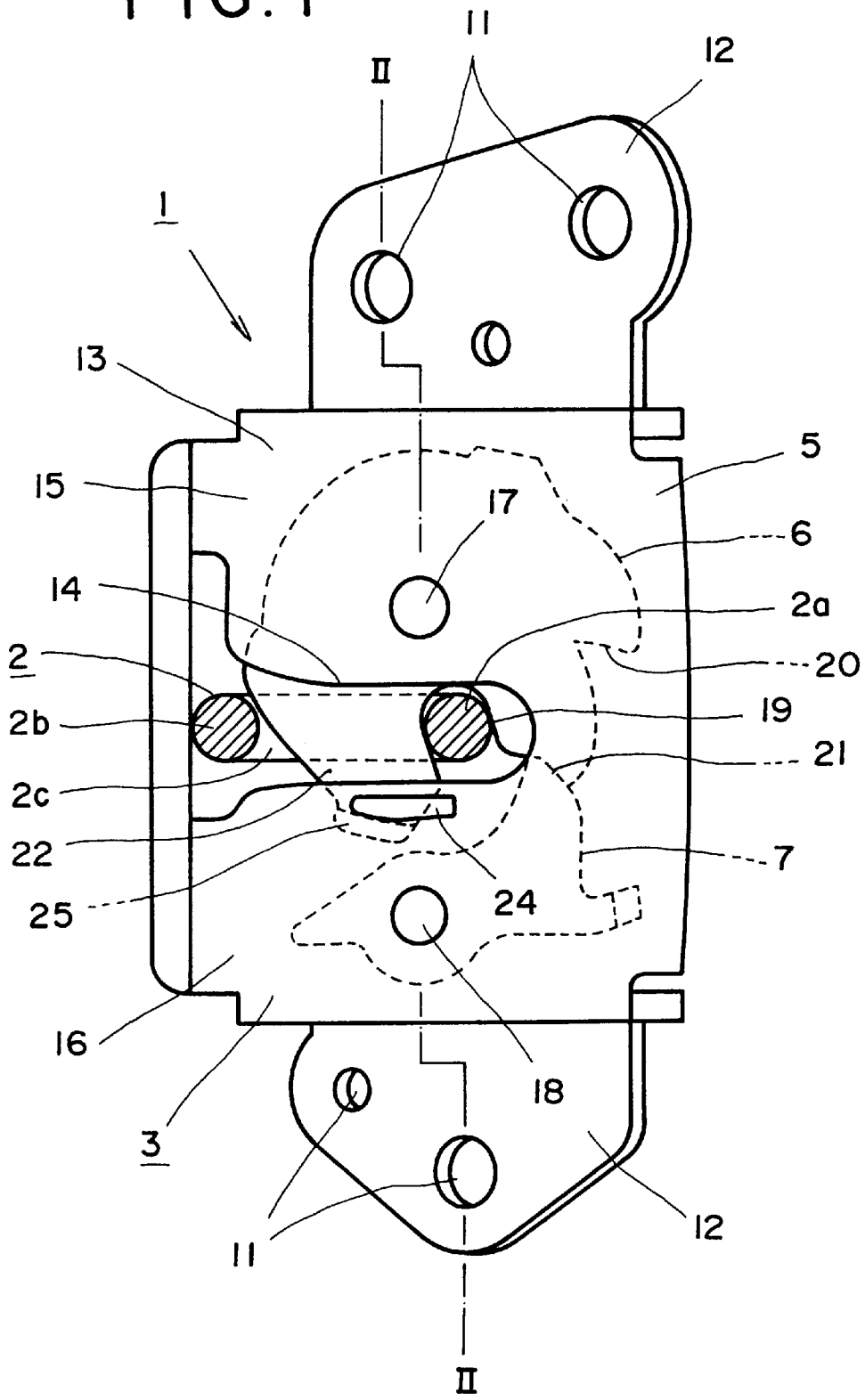
FIG. 1 is a front view of a door latch device of the present invention.

One embodiment of the present invention will next be described with reference to the drawings. A door latch device of the present invention has a latch assembly 1 fixed to one of a door and a vehicle body, and a U-shaped striker 2 fixed to the other of the door and the vehicle body. A housing 3 of the latch assembly 1 contains a main base 4, a metallic sub base 5, and a space 8 formed between the main and sub bases 4, 5. A latch 6 having a recess 4 formed by two arms 22 and 22' for engaging with the striker 2 and a ratchet 7 for engaging with the latch 6 are rotatably mounted in the space 8.

A main attaching portion 10 having a through hole 9 is formed on each of both sides of the main base 4. A sub attaching portion 12 having a through hole 11 is formed on each of both sides of the sub base 5. The housing 3 is fixed to the door or the vehicle body by bolts (not shown) inserted into the holes 9, 11.

The sub base 5 has a plate 13 substantially parallel to a rotational plane of the latch 6. A horizontal approach path 14 having a substantial U-shape is formed in the parallel plate 13. The striker 2 is advanced into the approach path 14 when the door is moved toward a door-closed position from a door-open position. The parallel plate 13 is partitioned by a first plate or an upper plate 15 and a second plate or a lower plate 16 with the approach path 14 as a boundary.

Figure 4:
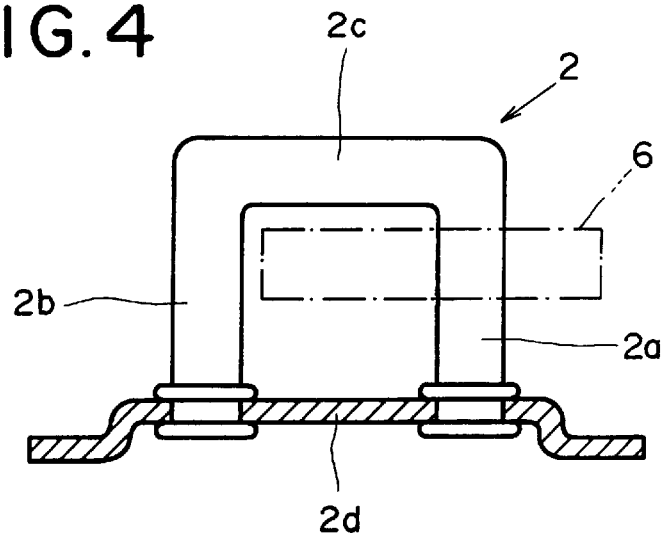
FIG. 4 is a plan view of a striker.

As shown in FIG. 4, the striker 2 has a U-shaped rod which consists of a first leg 2*a* for engaging with the latch 6, a second leg 2*b* parallel to the first leg 2*a* and a connecting portion 2*c* for connecting a front end of the first leg 2*a* and a front end of the second leg 2*b*, and a base plate 2*d* to which a rear end of the first leg 2*a* and a rear end of the second leg 2*b* are fixed. The base plate 2*d* is fixed to the vehicle body or the door.

Figure 2:
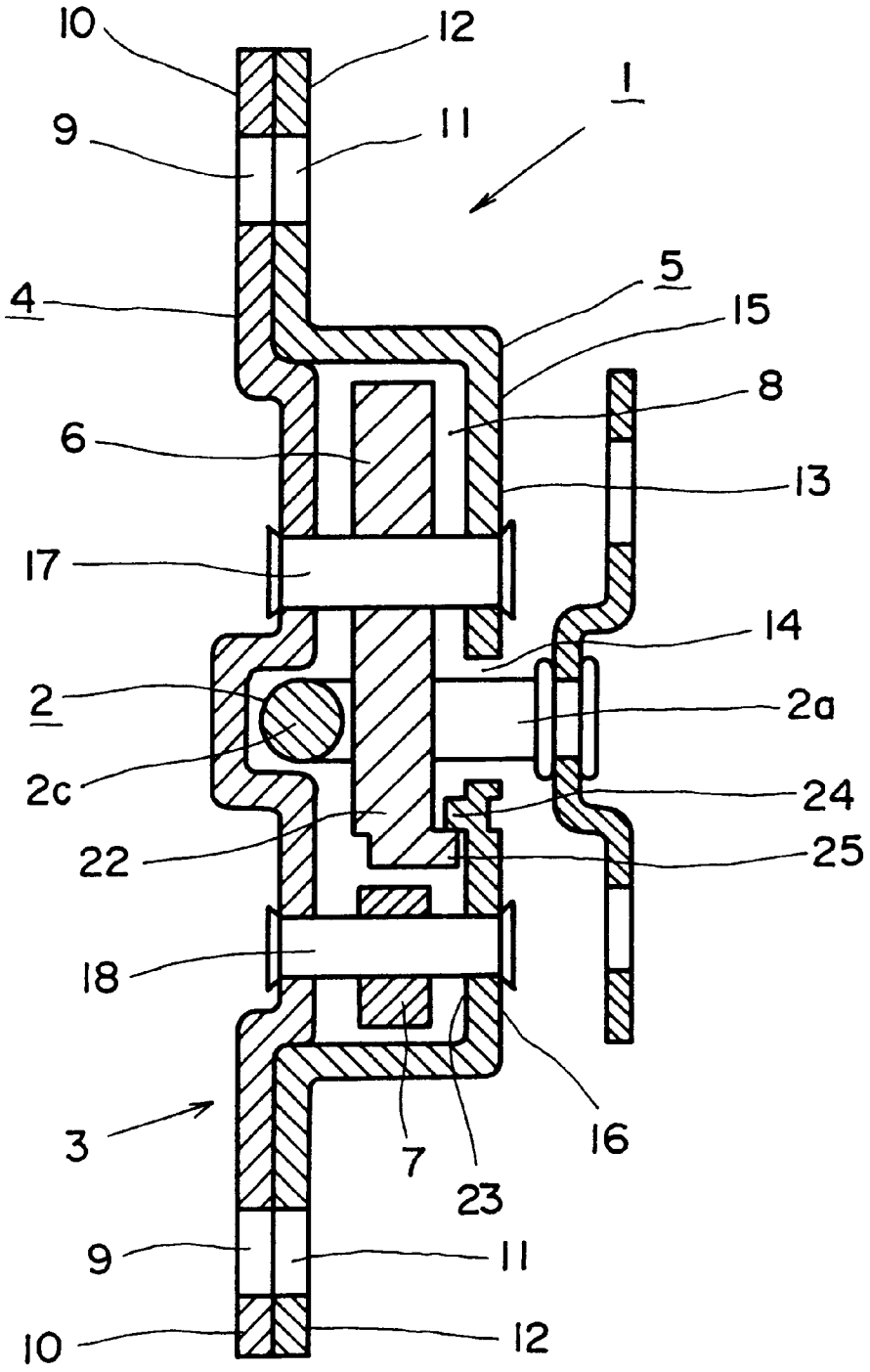
FIG. 2 is a cross-sectional view taken along line II—II of FIG. 1.
Figure 3:
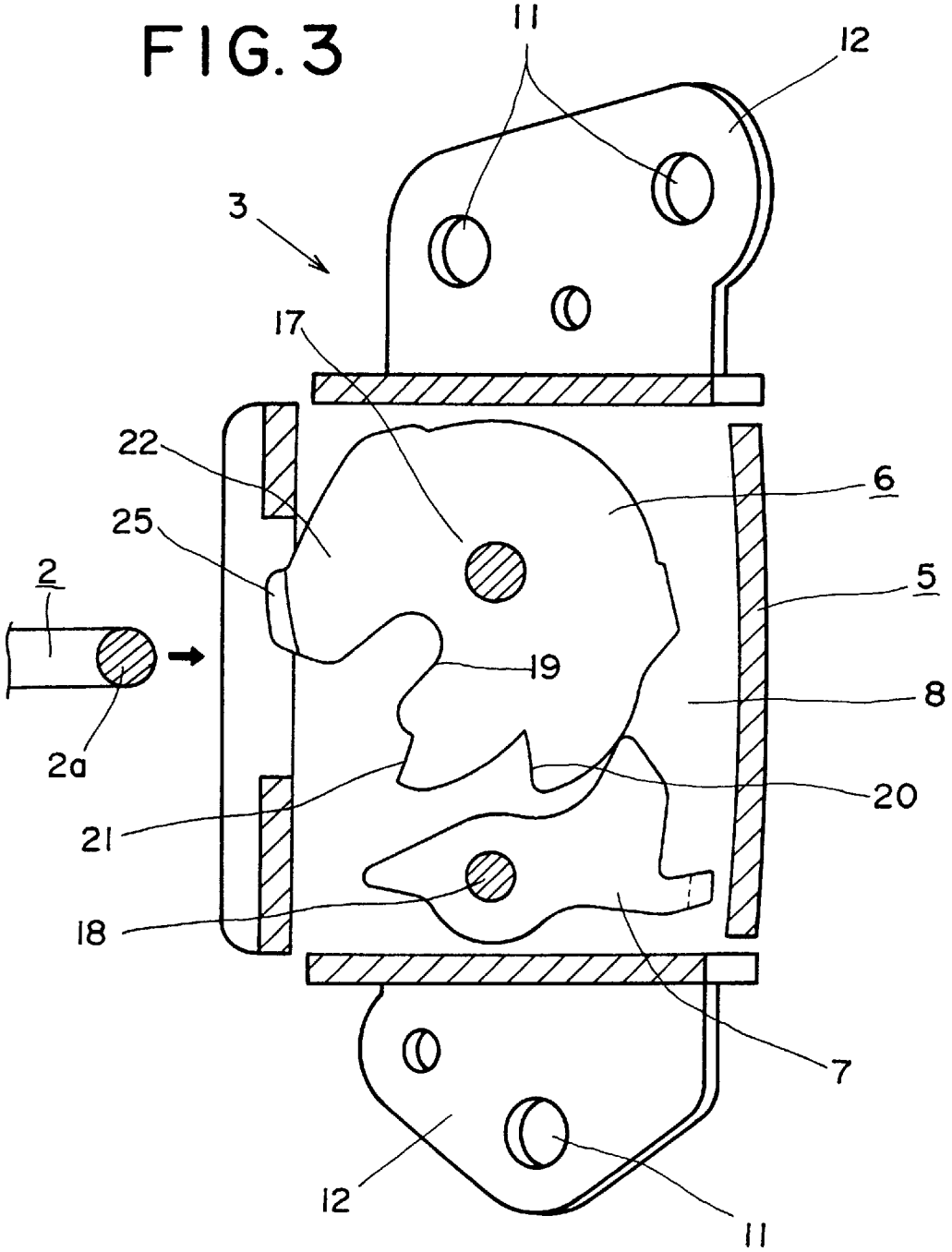
FIG. 3 is a longitudinal sectional front view of the door latch device.

The latch 6 is rotatably attached to the housing 3 by a latch shaft 17 and is held in a door-open position of FIG. 3 by a resilient force of a latch spring (not shown) when the door is in the door-open state. The ratchet 7 is rotatably attached to the housing 3 by a ratchet shaft 18 and is biased in a counterclockwise direction in FIG. 3 by a resilient force of a ratchet spring (not shown). In the first embodiment shown in FIGS. 1 to 5, one end portion of the latch shaft 17 is fixed to the first plate 15 of the parallel plate 13, and one end portion of the ratchet shaft 18 is fixed to the second plate 16. However, in a second embodiment shown in FIG. 6, both one end portions of the shafts 17, 18 are fixed to the same plate of the parallel plate 13.

The latch 6 is formed into a substantially circular shape by stamping a metal plate. When the striker 2 is advanced into the approach path 14 by closing the door, the first leg 2*a* of the striker 2 comes into contact with a U-shaped groove 19 of the latch 6 and rotates the latch 6 counterclockwise against the resilient force of the latch spring. When the latch 6 reaches a half-latch position (initial door-closed position) due to the contact with the striker 2, the ratchet 7 is engaged with a first step portion 20 of the latch 6, and the ratchet 7 is engaged with a second step portion 21 of the latch 6 when the latch 6 reaches a full-latch position (complete door-closed position), thereby the engagement of the latch 6 and the striker 2 is held.

The latch 6 has an arm 22 which is one of the two arms 22, 22' forming recess 4 which extends in a radial direction of the latch shaft 17. When the latch 6 is in the full-latch position, a tip end of the arm 22 goes beyond the approach path 14 and is overlapped with the second plate 16 of the parallel plate 13 as shown in FIGS. 1 and 2. On an inside surface 23 of the second plate 16 adjacent to the approach path 14, a raised portion 24 projecting toward the main base 4 is formed by emboss-press processing. The raised portion 24 is preferably formed into an arc shape with the latch shaft 17 as a center. At the tip end of the arm 22, a hook 25 extending toward the parallel plate 13 is formed by emboss-press processing. The hook 25 is preferably formed in an arc shape with the latch shaft 17 as a center. When the latch 6 is located in the full-latch position, the hook 25 is opposed to the raised portion 24. A distance between the hook 25 and the latch shaft 17 is set to be longer than a distance between the raised portion 24 and the latch shaft 17.

Operation

When the door is moved toward the door-closed position from the door-open position, the striker 2 is advanced into the U-shaped approach path 14 of the housing 3, and the first leg 2*a* of the striker 2 then comes into contact with the U-shaped groove 19 of the latch 6 and rotates the latch 6 toward the full-latch position. When the latch 6 reaches the full-latch position, the ratchet 7 is engaged with the second step portion 21 of the latch 6 so that the door is held in the door-closed position.

Figure 5:
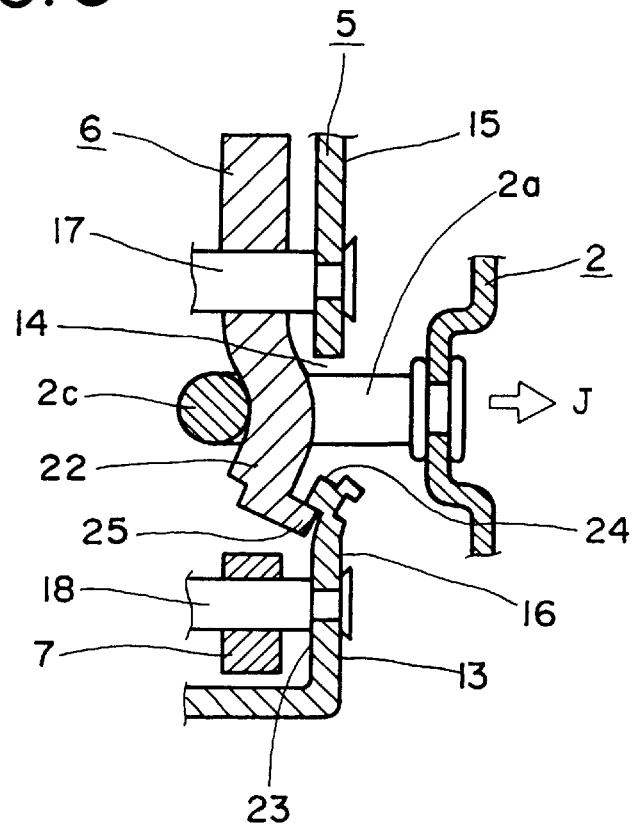
FIG. 5 is an explanatory view showing a state in which a load is applied to the striker in a direction parallel to an axis of a latch shaft.
Figure 6:
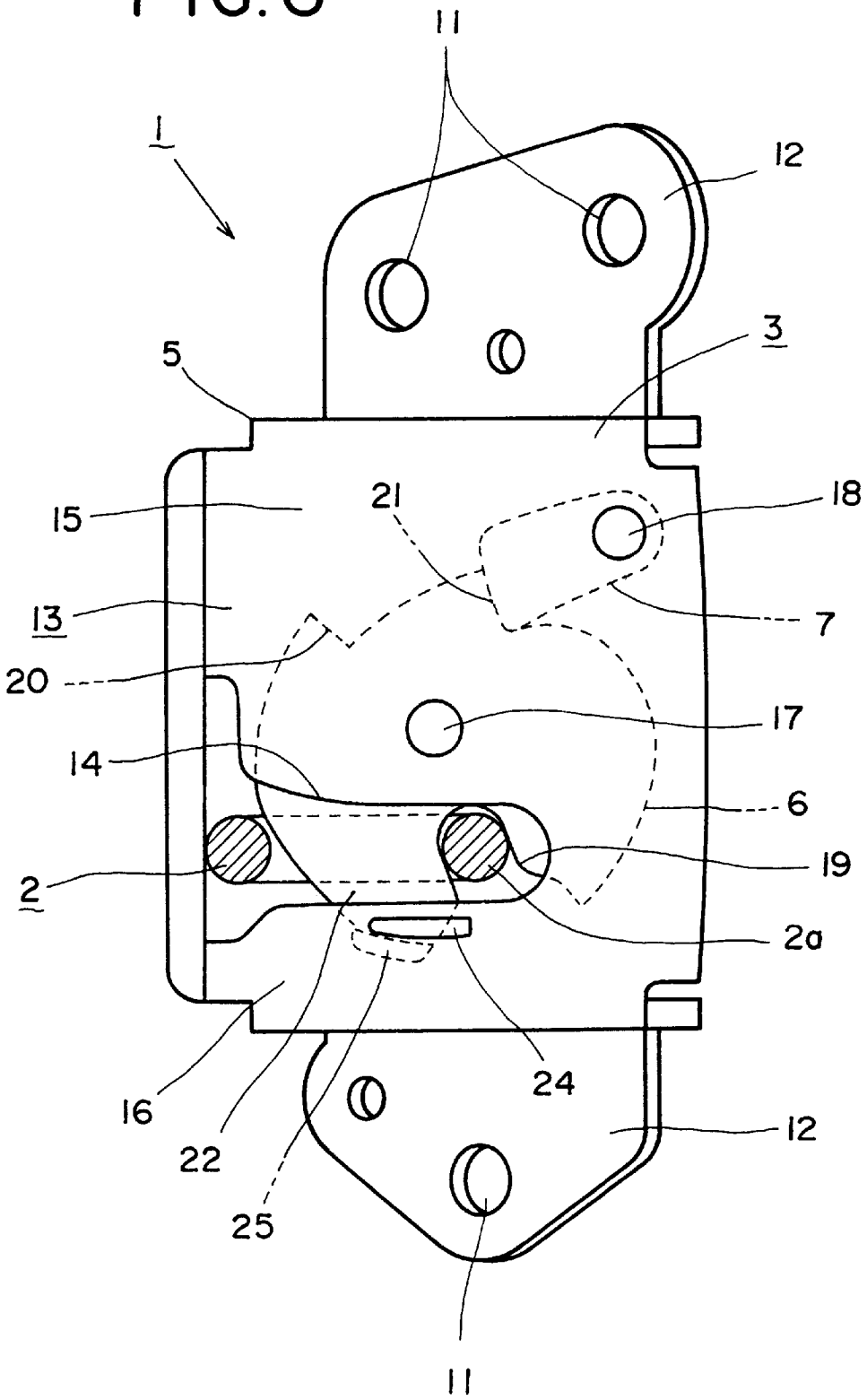
FIG. 6 is a front view of a door latch device in accordance with another embodiment of the present invention.

When the latch 6 reaches the full-latch position, the tip end of the arm 22 of the latch 6 goes beyond the approach path 14 through between the first leg 2*a* and the second leg 2*b* of the striker 2, and is overlapped with the second plate 16 of the parallel plate 13, then the hook 25 of the arm 22 is opposed to the raised portion 24 formed on the second plate 16. In this state, when a strong external force in the direction of an arrow J parallel to an axis of the latch shaft 17 is applied to the striker 2 as shown in FIG. 5, the latch 6 and the parallel plate 13 are bent or displaced in the direction of the arrow J, and the hook 25 of the arm 22 is then engaged with the lower surface of the raised portion 24 on the second plate 16 to prevent further deformations of the latch and second plate. Therefore, in the present invention the striker is not easily disengaged from the latch 6.

Thus, in the present invention, the strengths of the latch 6 and the sub base 5 of the present invention in the direction of the arrow J can be increased without increasing their thickness.

Further, the latch device of the present invention is simply constructed such that the raised portion is formed in the sub base and the hook is formed in the latch. Therefore, weight and cost of the latch device are not substantially increased. Further, the construction of the present invention is very easily applied to various kinds of conventional latch devices.

What is claimed is:

1. A vehicle door latch device comprising:

a housing adapted to be fixed to one of a door and a vehicle body, the housing having a main base, a metallic sub base and a space formed between the main base and the sub base;

a U-shaped striker adapted to be fixed to the other of the door and the vehicle body;

a metallic latch rotatably mounted in the space by a latch shaft and engageable with the striker for keeping the door in a door-closed position; and a ratchet rotatably mounted in the space and engageable with the latch for holding the engagement of the latch and the striker;

said sub base having a parallel plate substantially parallel to a rotational plane of the latch and an approach path formed on the parallel plate for receiving the striker when the door moves toward the door-closed position;

said parallel plate having a first portion and a second portion partitioned by the approach path as a boundary; and said latch shaft having one end attached to the first portion;

wherein said second portion has a raised portion projecting toward the main base, and said latch has a hook which is engageably opposed to the raised portion when the door is in the door-closed position wherein a distance between the hook and tile latch shaft is set to be longer than a distance between the raised portion and the latch shaft.

2. The vehicle door latch device according to claim 1, wherein said raised portion has a first surface facing the approach path and a second surface opposite to the first surface and engageable with the hook.

3. The vehicle door latch device according to claim 1, wherein said raised portion is substantially formed into an arc shape with the latch shaft as a center.

4. The vehicle door latch device according to claim 1, wherein said hook is substantially formed into an arc shape with the latch shaft as a center.

5. The vehicle door latch device according to claim 1, wherein said hook and said raised portion are respectively formed in the latch and the sub base by emboss-press processing.

6. The vehicle door latch device according to claim 1, wherein the latch has a recess for engaging the striker formed by a first and a second arm said hook being located on said first arm.

7. The vehicle door latch device according to claim 6, wherein said first arm locks the striker in the recess of the latch when the door is in the door-closed position and wherein engagement of the hook and the raised portion limit disengagement of the striker from the latch under force.

* * * * *